United States Patent [19]

Morishita et al.

[11] Patent Number: 4,596,692

[45] Date of Patent: Jun. 24, 1986

[54] PROCESS FOR FORMING A WEAR-RESISTANT LAYER ON A SUBSTRATE

[76] Inventors: Tsuyoshi Morishita, No. 10-17, Hataga 2-chome, Aki-ku, Hiroshima-shi, Hiroshima-ken; Sigemi Osaki, No. 2304, Higashikaita, Kaita-cho, Aki-gun, Hiroshima-ken; Yasuhumi Kawado, No. 8-26, Asahi-machi 2-chome, Iwakuni-shi, Yamaguchi-ken; Yukio Shimizu, No. 20-28, Higashihouwa, Yayoi-cho, Toyohashi-shi, Aichi-ken; Toshiharu Konishi, No. 58, Uehara, Ueno-cho, Toyohashi-shi, Aichi-ken; Takahumi Sakuramoto, No. 7-41, Shimohozumi 4-chome, Ibaragi-shi, Osaka-fu, all of Japan

[21] Appl. No.: 702,603

[22] Filed: Feb. 19, 1985

[30] Foreign Application Priority Data

Feb. 24, 1984 [JP] Japan ..... 59-33752

[51] Int. Cl.[4] ..... B22F 7/00

[52] U.S. Cl. ..... 419/7; 419/6; 419/8; 419/9; 419/23; 419/36; 419/43; 419/57; 419/58; 419/60; 419/65; 419/69; 428/557; 428/678; 428/682

[58] Field of Search ..... 419/5–9, 419/10, 12, 23, 47, 36, 57, 43, 58, 60, 65, 69; 428/678, 682, 557

[56] References Cited

U.S. PATENT DOCUMENTS

| | | | |
|---|---|---|---|
| 3,743,556 | 7/1973 | Breton et al. | 156/62.8 |
| 4,000,980 | 1/1977 | Morishita et al. | 419/10 |
| 4,223,434 | 9/1980 | Wang et al. | 419/5 |

FOREIGN PATENT DOCUMENTS 5183834 7/1976 Japan .

*Primary Examiner*—Stephen J. Lechert, Jr.

[57] ABSTRACT

A process for forming a wear-resistant, sintered layer on an iron based substrate which comprises steps of providing a first alloy sheet containing 94 to 99 weight % of Fe-Cr type alloy particles and 6 to 1 weight % of acryl binder and a second alloy sheet containing 94 to 99 weight % of eutectic alloy particles and 6 to 1 weight % of acryl binder, placing the first and second alloy sheets in a superposed condition on the substrate, and heating in a non-oxidating atmosphere to a temperature which is higher than a solidus temperature of the eutectic alloy but lower than a solidus temperature of the Fe-Cr type alloy.

20 Claims, 4 Drawing Figures

(a)

(X180)

(b)

(X200)

(c)

(X200)

(d)

(X200)

(e)

(X200)

(a)

(X 180)

(b)

(X 200)

(c)

(X 200)

(d)

(X 200)

(e)

(X 200)

(a)

(X 180)

(b)

(X 200)

(c)

(X 200)

(d)

(X 200)

(e)

(X 200)

PROCESS FOR FORMING A WEAR-RESISTANT LAYER ON A SUBSTRATE

BACKGROUND OF THE INVENTION

1. Field of the Invention

The present invention relates to a process for forming a wear-resistant, sintered layer on a metallic substrate.

2. Description of Prior Art

Conventionally, various proposals have been made for forming a wear-resistant, sintered layer on a metal substrate. For example, Japanese patent publication 53-19540 corresponding to the U.S. Pat. No. 3,743,556 discloses a process for coating a metal substrate with a thin coating composed of filler particles dispersed in a metallic matrix. According to the proposal, there are provided a first layer including filler particles selected from abrasives, metals and alloys and dispersed in an organic binder, and a second layer including a metal or an alloy which has a solidus temperature lower than that of the filler particles and can wet in a molten state the filler particles. The layers are then applied to the substrate and heated to a temperature which is higher than the solidus temperatures of the metal or alloy in the second layer but lower than that of the filler particles whereby the organic binder is dissipated and the filler particles are dispersed in the molten matrix of the metal or alloy in the second layer. According to the process, the filler particles and of relatively large particle size and are not molten during the process so that the original particle size is maintained as it is. Therefore, the substrate having the coating thus produced has a disadvantage of damaging a cooperating surface when it is used as a sliding member.

As an alternative process, it has been proposed to use an alloy powder sheet to form a wear-resistant layer. For example, in Japanese patent application 50-9398 on Jan. 21, 1975 and disclosed for public inspection on July 22, 1976 under the disclosure number 51-83834, there is disclosed a process wherein an alloy particle sheet comprised of alloy particles dispersed in a binder of thermoplastic acryl resin is attached by means of a suitable solvent such as toluene to the metallic substrate and heated in an atmosphere so that a coating of the alloy particles is formed on the substrate. It should however be noted that the process is disadvantageous in that the alloy particles cannot be satisfactorily supported on the substrate in the progress of the process in a temperature wherein the resin binder is dissipated under heat. Thus, when it is desired to form a coating on an inclined surface, a curved surface or a downwardly faced surface, the alloy particles may fall from the substrate during the process. A further problem in the process be is that the alloy sheet has a tendency of shrinking in the sintering process so that there is a difficulty in dimensional control. Thus, it is required to carry out after the sintering process.

OBJECT OF THE INVENTION

It is therefore an object of the present invention to provide a process of forming a metallic substrate with a wear-resistant coating which has a dimensional stability throughout the process.

Another object of the present invention is to provide a process of forming a wear-resistant coating which has a less possibility of damaging a cooperating surface when it is used as a sliding surface.

A further object of the present invention is to provide a process of forming a wear-resistant coating on a metallic substrate, which is substantially free from the problem of the coating material from being fallen off the substrate.

SUMMARY OF THE INVENTION

According to the present invention, the above and other objects can be accomplished by a process in which a metallic substrate is applied at a surface with a first sheet containing particles of a Fe-Cr type alloy and a second sheet containing particles of eutectic alloy and heated to have the eutectic alloy molten so that the molten eutectic alloy is caused to enter voids which are produced in the first sheet during the process. Thus, the process in accordance with the present invention comprises steps of providing on a surface of a metallic substrate first particulate alloy layer containing 94 to 99 weight % of Fe-Cr type alloy particles and 6 to 1 weight % of acryl binder and a second particulate alloy layer containing 94 to 99 weight % of eutectic alloy particles and 6 to 1 weight % of acryl binder, and heating in a non-oxidating atmosphere to a temperature which is higher than a solidus temperature of the eutectic alloy but lower than a solidus temperature of the Fe-Cr type alloy.

The first and second alloy layers may be provided in sheet forms and applied to the surface of the substrate. The sheet of wear-resistant eutectic alloy particles may be provided by mixing with the acryl binder with an addition of an appropriate solvent and rolling the mixture into a sheet. It has been found that a particulate eutectic alloy sheet containing 85 to 97 volume % of eutectic alloy particles and 15 to 3 volume % of acryl binder shows a strong adhesion to the metallic substrate even under a temperature higher than 400° C. The apparent density of the alloy sheet is 4.0 to 6.0 g/cm$^3$ and the alloy particles occupy 50 to 70% in volume. After sintering, the sheet has an apparent density greater than 7.33 g/cm$^3$ which is 94% of the theoretical density. Thus, there will be shrinkage which is as large as 10 to 25% in the sintering process. It has been found that the shrinkage can remarkably be decreased by combining a sheet containing Fe-Cr type alloy particles with the eutectic alloy particle sheet. The Fe-Cr type alloy has a wear-resistance which is lower than that of the eutectic alloy, however, the former has a solidus temperature higher than that of the latter. By carrying out the sintering process at a temperature higher than the solidus temperature of the eutectic alloy particles but lower than that of the Fe-Cr type alloy particles, the binder is dissipated to produce voids in the layer of the Fe-Cr type alloy particles and molten eutectic alloy enters the voids preventing the shrinkage of the sheet. It has also been found that there are produced composite carbides such as (Fe Cr Mo) (P C) through reactions between Fe and Cr and the eutectic alloy is entered into the voids in the layer of the Fe-Cr type alloy.

ALLOY PARTICLES

The Fe-Cr type alloy particles contained in the first layer may include particles of an alloy containing approximately 5 to 20 weight % of Cr, such as Fe-Cr type corrosion resistant steel and Fe-Cr-Ni type corrosion resistant steel. The aforementioned steels have a hardness lower than 200 Hv and show a low wear resistance.

As the eutectic alloy particles contained in the second layer, it is preferable to use a Fe-M-C type ternary eutectic alloy, weherein M is one or more of Mo, B and P. It is preferable to contain P because it shows a strong diffusion to the substrate as C does. The eutectic alloy may additionally include Cr, V, Nb, W and Ni. More specifically, the eutectic alloy should preferably be of such a type which has 20 to 100 volume % of liquid phase in a temperature between 1000° and 1150° C., the liquid phase having a good wettability to the substrate and the alloy particles in the first layer. With the liquid phase less than 20 volume %, there will be a shortage of the liquid phase so that it will become difficult to obtain an effective adhesion to the substrate. Further, it will become difficult to fill the voids in the first layer and to produce a hard, wear-resistant composite carbides.

Where the eutectic alloy is of a Fe-P-C type the P content itself has an effect of lowering the melting point. Further, it is coupled with the Fe and C contents to produce phosphorous eutectic crystals which are effective to improve the wear resistance. With the P content less than 1.0 weight %, the liquid phase will be less than 20 volume % so that there will be insufficient adhesion to the substrate and the voids in the first layer will not be adequately filled. With the P content greater than 5.0 weight %, a network of phosphorus eutectic crystals will be produced resulting in a remarkable decrease in tenacity. Thus, it is required that the P content be between 1.0 and 5.0 weight %.

The C content is effective to obtain a strong adhesion to the substrate. It is further coupled with the Fe and P contents to improve the strength of the substrate and to form a hard layer. The C content produces with the P content the aforementioned phosphorous eutectic crystals to thereby increase the density and produce a good adhesion to the substrate. With the C content less than 3.0 weight %, there will be produced less quantity of cystallites of low melting point so that the adhesion to the substrate will become insufficient. Further, the voids in the first layer will not be adequately filled so that sufficient amount of wear resistant, hard composite carbides will not be produced. With the C content greater than 5.0 weight %, there will be produced a network of carbides with rough grains which will cause a decrease in tenacity.

Where the eutectic alloy is of a Fe-Mo-C type, the Mo content contributes in increasing the strength of the substrate and forming a hard phase. Further, it is coupled with the Fe and C contents to decrease the melting point. With the Mo content less than 5.0 weight %, a sufficient amount of hard phase will not be produced. Further, there will be a shortage of liquid phase. With the Mo content greater than 20.0 weight %, there will be an excessive amount of liquid phase which will make the material brittle.

Where the eutectic alloy is of a Fe-B-C type, the B content function to produce a hard phase and lower the melting point by being coupled with the Fe and C contents. With the B content less than 1.0 weight %, there will be an insufficient amount of ternary eutectic crystals so that the wear resistance and the anit-seizure property will be adversely affected. With the B content greater than 6.0 weight %, the material will become very brittle.

In order to improve the strength and the wear resistant property of the Fe-M-C type eutectic alloy, addition of Cr, V, W, Nb, Ta and or Ti will be effective. These elements function to improve the strength, particularly the tenacity of the substrate. Further, they are coupled with the C content to produce a hard phase. With the content of these elements greater than 10 weight %, the effects will be saturated.

Si may additionally be used to improve fluidity of molten alloy in the sintering process and obtain a good wettable property to the substrate. With the Si content greater than 5.0 weight %, there will be an adverse effect on the hardness and the wear resistant property. Ni may be added to strengthen the substrate, however, with the Ni content greater than 5.0 weight %, there will be a decrease in the hard phase so that the seizure resistant property will be adversely affected. Mn has a similar function as Ni does so that it is preferred that it be added in an amount less than 5 weight %.

The particle size has a large influence on the porosity of the sintered layer. It is preferred that the particle size be finer than 150 mesh. With the particle size coarser than 150 mesh, the porosity of the sintered layer will accordingly be increased giving adverse effects on the wear resistance of the sintered layer.

ADHESIVE BINDER

The acryl binder for the first and second layer may preferably be selected from polymers of acryl esters and methacryl esters, copolymers of acryl esters and methacryl esters, and copolymers of these esters and monomers having functional groups copolymerizable with these esters. The binder is mixed with the alloy particles in an amount 6 to 1 weight % for 94 to 99 weight % of the alloy particles. With the binder content less than 1 weight %, the sheet will become too brittle so that flexibility of the sheet cannot be maintained. With the binder content greater than 6 weight %, there will be an adverse effect on the porosity of the sintered layer due to the excessive quantity of the resin. Further, a satisfactory adhesion to the substrate will not be obtained.

PREPARATION OF THE ALLOY PARTICLE SHEET

The alloy particle sheet can be prepared in various ways. For example, a solvent such as acetone, toluene and methylethylketone may be mixed with the binder in an amount of 100 to 1000 part in weight for 100 part in weight of the binder and formed into a sheet configuration in mold with an intervention of a separating paper between the mixture and the mold. Thereafter, the solvent is evaporated and the binder sheet is rolled into a thickness of 0.5 to 5.00 mm.

Alternatively, the binder may be mixed with the alloy particles without using any solvent and agitated under heat if required. Then, the mixture is formed into a sheet.

APPLICATION OF THE ALLOY PARTICLE SHEETS

The alloy particle sheets can readily be adhered to the substrate surface by pressing the sheets on the substrate. If necessary, however, the acryl resin which is of the same type as the binder in the sheet may be in advance applied to the substrate so that the sheet is adhered to the substrate through the resin. The adhesive resin may be applied in the form of a tape.

It is preferred that the Fe-Cr type alloy particle sheet be attached to the substrate surface and the eutectic alloy particle sheet be then attached to the first mentioned sheet. However, the order of attaching the sheets may be reversed. There is no specific limitaion with respect to the thickness of each sheet, howerver, a suitable thickness for each sheet is 0.1 to 5.0 mm.

SINTERING

It is required that the heating be carried out under a non-oxidizing atmosphere such as the atmosphere of inactive gas, for example, nitrogen and argon, a reductant gas, for example, hydrogen, or vacuum.

Preferably, the rate of heating is lower than 40° C./min. With a higher heating rate, components of low boiling point in the binder is suddenly evoporated so that the particle sheets may possibly be broken and bubbles may be produced in the interface between the substrate and the adjacent sheet or the interface between the sheets causing removal of the sheet. It is preferred to carry out a preheating before the temperature is increased to the sintering temperature. The preheating may be carried out by holding the workpiece under a temperature of 150° to 380° C., preferably 200° to 350° C. for 5 minutes. Through the preheating process, the acryl resin in the sheet and the acryl resin applied between the substrate and the adjacent sheet are subjected to a pyrolytic polycondensation without being completely burnt producing tar or pitch-like substances. These substances function to maintain and adequate adhesive power even under a temperature higher than 300° C. to hold the sheets in place. Therefore, it is possible to prevent the alloy particle sheets from being removed from the substrate even when the preheated workpiece is transferred and subjected to vibrations or shock loads during the transportation. With the preheating temperature lower than 150° C., the pyrolytic reaction will not be produced to a sufficient extent so that adequate amount of tar or pitch-like substances will not be obtained. With the preheating temperature higher than 380° C., the resin is rapidly thermally decomposed so that an adequate quantity of tar or pitch-like substances cannot be produced. A preheating time less than 5 minutes will be insufficient to produce an adequate quantity of the aforementioned substances. The preheating time may be determined in accordance with the temperature and the type of the resin. In general, it is not necessary to hold the workpiece under the preheating temperature for more than 120 minutes.

The coating produced in accordance with the process of the present invention has a good wear-resistant property and does not cause a damage or scratch on the cooperating surface. The layers of the alloy particles can be held firmly on the substrate when the workpiece is being heated from the room temperature to the sintering temperature. Further, the coating can be formed with a very small shrinkage so that the dimensional control can readily be made.

BRIEF DESCRIPTION OF THE DRAWINGS

FIG. 1(*b*) is a C Kα characteristic X-ray picture of the specimen shown in FIG. 1(*a*);

FIGS. 1(*c*), (*d*) and (*e*) show respectively P, Mo and Cr Kα characteristic X-ray pictures;

FIGS. 2(*b*) through 2(*e*) respectively show C, P, Mo and Cr Kα characteristic X-ray pictures of the specimen shown in FIG. 2(*a*);

EXAMPLES

Figure 1:
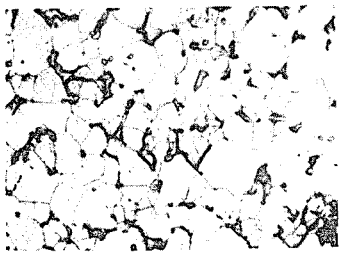
FIG. 1(*a*) is a microscopic picture of a comparative specimen.
Figure 1:
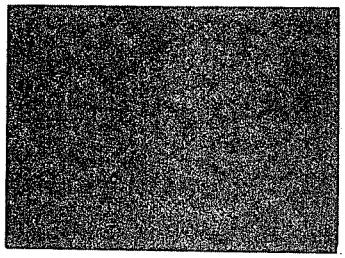
Figure 1:
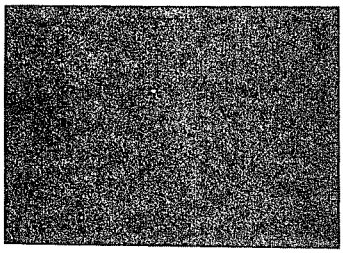
Figure 1:
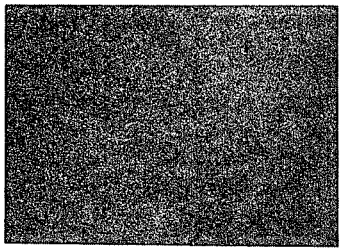
Figure 1:
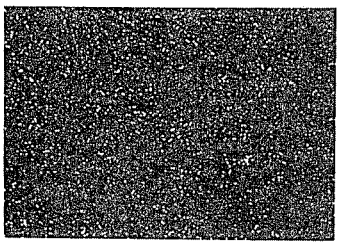

Examples of the present invention will now be described Fe-Cr type alloy particles of particle size finer than 200 mesh having compositions as shown in Table 1 are mixed and agitated in an amount of 93 volume % (97.55 weight %) with 7 volume % (2.45 weight %) of a copolymer of acryl ester and acryl. Thereafter, the mixture is rolled to form first alloy particle sheets A1, B1 and C1 as shown in Table 1. Similarly, second alloy particle sheets A2, B2 and C2 are formed by using eutectic alloy particles of particle size finer than 200 mesh having compositions shown in Table 1. As a comparative specimen, a sheet D is prepared by using a 1:1 mixture of Fe-Cr type alloy particles and eutectic alloy particles. The first sheet of 10 mm×10 mm in size is then attached to a surface of a steel substrate through an adhesive tape of 10 microns thick which is of the same composition as the acryl binder in the sheet. The second sheet of 10 mm×10 mm in size is further attached to the first sheet through an adhesive tape of the same type to for a specimen. In accordance with the identifying characters in the sheets, the specimens are respectively identified as A, B, C. Similarly, a specimen D is prepared by adhering the sheet D. The specimens A, B, C and D are heated in a hydrogen atmosphere to 300° C. with a heating rate 15° C./min and maintained at the temperature for 60 minutes. Then, the specimens are heated to 1100° C. with a heating rate 10° C./min and maintained at the temperature for 20 minutes before they are cooled. The sintered layers thus formed are measured in respect of the density, hardness and the shrinkage. The results are shown in Table 1.

TABLE 1

| SPECIMENS | | | INVENTION A | INVENTION B | INVENTION C | COMPARATIVE EXAMPLE |
|---|---|---|---|---|---|---|
| 1st SHEET | | | A1 | B1 | C1 | D |
| Cr | 12.22 (wt %) | thickness (mm) | 2.0 | 2.0 | 2.0 | 2.0 |
| C | 0.014 | | | | | |
| P | 0.018 | | | | | |
| Si | 0.79 | density(g/cm$^3$) | 3.8 | 4.2 | 4.6 | 4.6~4.9 |
| S | 0.003 | | | | | |
| Mn | 0.08 | porosity*(%) | 51.3 | 46.2 | 40.0 | |
| Ni | 0.08 | *Porosity is determined with the assumption that the acryl binder is completely removed | | | | |
| Fe | balance | | | | | |
| 2nd SHEET | | | A2 | | C2 | |
| C | 4.2(%) | thickness | 1.6 | 1.5 | 1.4 | |
| P | 2.46 | | | | | |

TABLE 1-continued

| | | | | | |
|---|---|---|---|---|---|
| Mo | 10.6 | | | | |
| Cr | 2.73 | density(g/cm$^3$) | 4.80~4.85 | 4.80~4.85 | 4.80~4.85 |
| Si | 0.52 | | | | |
| S | 0.037 | | | | |
| Mn | 0.37 | | | | |
| Ni | 0.05 | | | | |
| Fe | balance | | | | |
| SINTERED LAYER | | density(g/cm$^3$) | 7.76 | 7.65 | 7.50 | 7.65 |
| | | hardness H R C | 63~65 | 61~64 | 57~60 | 62~65 |
| | | shrinkage(% length) | 0.7~1.0 | 1.2~1.8 | 1.5~2.5 | 15 |

In Table 1, it will be noted that the shrinkage in the specimens A, B or C is remarkably small as compared with the comparative specimen D.

Further comparative specimens are prepared by attaching only the first sheet A1 and only the second sheet A2, respectively and heating these specimens under vacuum to 1090° C. and maintaining at the temperature for 20 minutes. Thereafter, the specimens are cooled down at a rate of 3° C./min. to 900° C. and maintained at the temperature for 30 minutes. Then, the specimens are cooled by $N_2$ gas. A further specimen is prepared by attaching the first and second sheets A1 and B1 to the substrate and subjecting to the same sintering process.

FIG. 1(*a*) is a microscopic picture of the comparative specimen which is prepared by using the first sheet only and etched for the purpose of photographing. In FIG. 1(*a*), the gray area shows ferite and there are crystalline boundaries and voids. FIG. 1(*b*) is a C K characteristics X-ray picture and there is no sign of C. FIGS. 1(*c*) and (*d*) respectively show P and Mo K characteristics X-ray picture and there are no signs of P and Mo. FIG. 1(*e*) is a Cr K characteristic picture and it will be noted that there is a uniform distribution of Cr.

Figure 2:
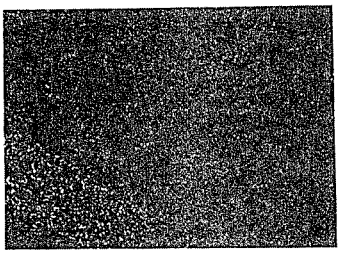
FIG. 2(*a*) is a microscopic picture of another comparative specimen.
Figure 2:
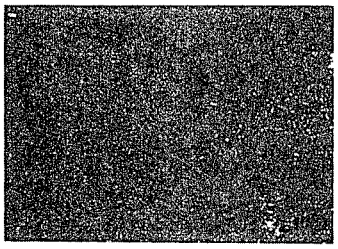
Figure 2:
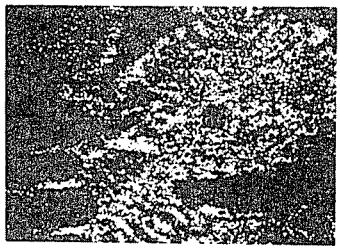
Figure 2:
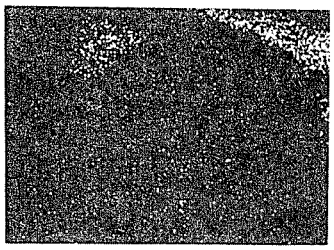

FIG. 2(*a*) is a microscopic photograph of the comparative specimen which is prepared by using the second sheet only the etched for the purpose of photographing. The white area shows a composite structure of the composite carbides, the eutectic structure and the martensite structure of Fe, Cr, Mo and P. The sintered material has coarse grains of carbides so that it is very brittle. FIGS. 2(*b*) through (*e*) show respectively the C, P, Mo and Cr K characteristic X-ray pictures. It will be noted that C and Cr are contained in greater quantities in the whitish carbides and the eutectic structure whereas P and Mo are contained in the eutectic structure.

Figure 3:
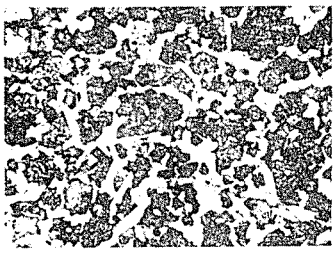
FIGS. 3(*a*) through 3(*e*) are pictures respectively corresponding to FIGS. 1(*a*) through 1(*e*) but showing the specimen prepared in accordance with the present invention; and, FIG. 4 is a diagram showing the results of wear resistant tests.
Figure 3:
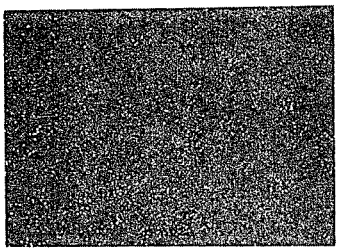
Figure 3:
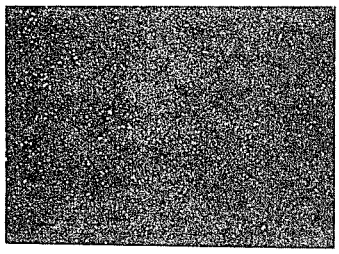
Figure 3:
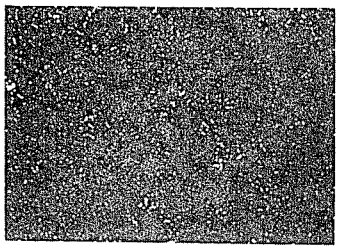
Figure 3:
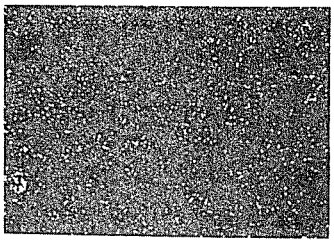

FIG. 3(*a*) shows a microscopic picture of the specimen which is prepared by using the first and second sheets A1 and A2 and etched for the purpose of photographing. It will be noted that finely divided carbides are dispersed throughout the sintered layer. Further, granulous carbides exist even in the substrate as shown by the whitish areas. FIGS. 3(*b*) through (*e*) respectively show the C, P, Mo and Cr K characteristic X-ray pictures and it will be noted that there are uniform distributions of C, P, Mo and Cr. It will therefore be understood that by using the first and second sheets in combination, it is possible produce finely divided carbides in the sintered layer and fine granulous carbides in the substrate. The sintered layer is excellent in tenacity and wear resistant property since it contains uniform distributions of C, P, Mo and Cr.

APPLIED EXAMPLE

Figure 4:
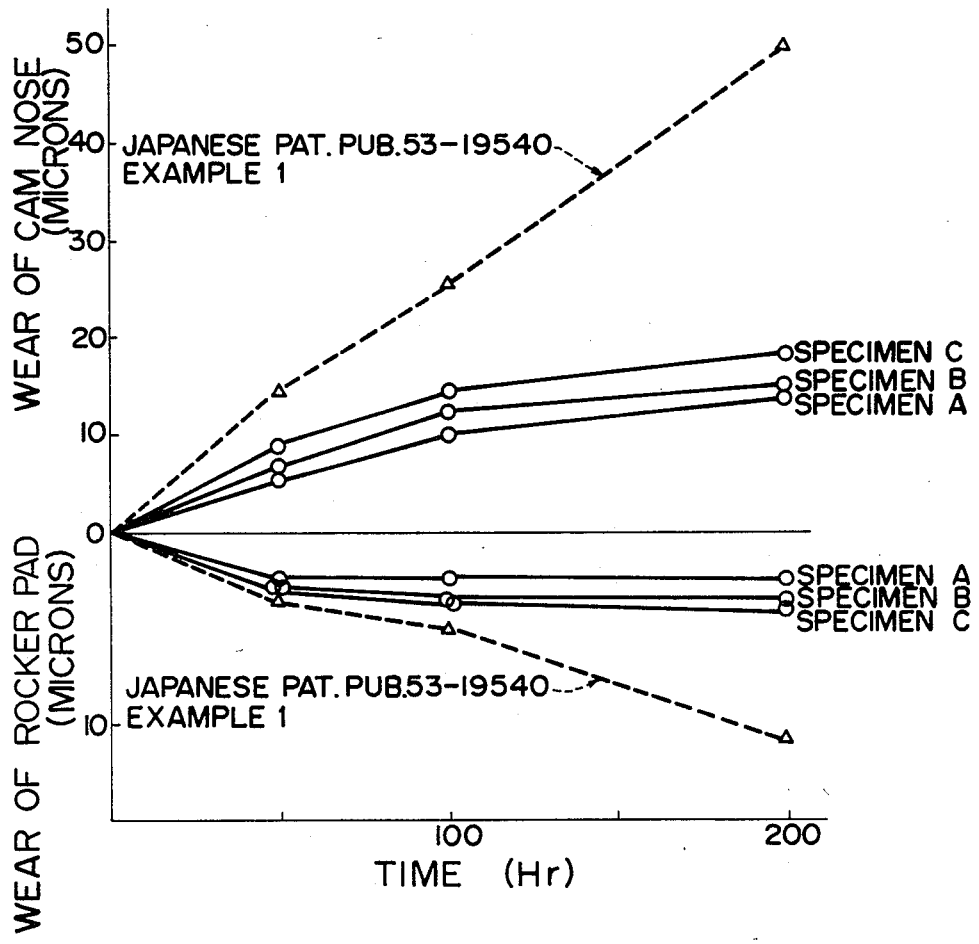

The sintered layers corresponding to the specimens A, B and C are produced in the form of chips which are molded in aluminum alloy rocker arms for 1500 cc gasoline engines. For comparison, a chip is formed by a process similar to that of example 1 of Japanese patent publication 53-19540 and the chip is also molded in an aluminum alloy rocker arm. The chips on the rocker arms are then subjected to wear tests by assembling the rocker arms on an engine and motoring the engine. The test conditions are as follows:

1500 cc engine motoring test
camshaft: alloy cost iron (3.5%C, 1.8%Si, 0.7%Mn, 0.3%Cr, the balance Fe) having a chilled structure of hardness in Vickers scale HV550 to 650, with a surface roughness 2 to 4 microns
maximum contact pressure: 57 kg/mm$^2$
rotating speed: 2000 rpm
lubricant: mobile SAE #20
oil temperature: 45° to 50° C.
surface roughness of the rocker pad: 2 to 3 microns The wear of the cam nose is measured by taking a wear-free area as the reference, the wear-free area being formed by providing on the cam nose ca area which is not subjected to a contact with the rocker pad. The wear on the rocker pad is determined as an average of the maximum depths of the worn recess measured along three parallel measuring lines parallel to the direction of the sliding movement. The results are shown in FIG. 4. It will be noted that the examples of the present invention show excellent results as compared with the example 1 of the Japanese patent publication.

We claim:

1. Process for forming a sintered layer on a metallic substrate comprising steps of providing on a surface of a metallic substrate a particulate alloy layer comprising a first lamina containing 94 to 99 weight % of Fe-Cr type alloy particles and 6 to 1 weight % of acrylic binder, superimposing on said first lamina a second lamina containing 94 to 99 weight % of eutectic alloy particles and 6 to 1 weight % of acryl binder, and heating said substrate in a non-oxidating atmosphere to a temperature which is higher than a solidus temperature of the eutectic alloy but lower than a solidus temperature of the Fe-Cr type alloy.

2. A process in accordance with claim 1 in which the Fe-Cr type particles contain 5 to 20 weight % of Cr and have a hardness less than Hv 200.

3. A process in accordance with claim 1 in which the eutectic alloy is of a Fe-M-C type wherein M is selected from Mo, B and P.

4. A process in accordance with claim 3 in which said Fe-M-C type alloy shows 20 to 100 volume % of liquid phase.

5. A process in accordance with claim 3 in which said Fe-M-C type alloy contains 3.0 to 5.0 weight % of C.

6. A process in accordance with claim 3 in which said Fe-M-C type alloy further contains less than 10 weight % of at least one of Cr, V, W, Nb, Ta and Ti.

7. A process in accordance with claim 1 in which the eutectic alloy is of a Fe-P-C type containing 1.0 to 5.0 weight % of P.

8. A process in accordance with claim 1 in which the eutectic alloy is of a Fe-Mo-C type containing 5.0 to 20.0 weight % of Mo.

9. A process in accordance with claim 1 in which the eutectic alloy is of a Fe-B-C type containing 1.0 to 6.0 weight % of B.

10. A process in accordance with claim 3 in which said Fe-M-C type alloy contains less than 5.0 weight % of Si.

11. A process in accordance with claim 3 in which said Fe-M-C type alloy contains less than 5.0 weight % of at least one of Ni and Mn.

12. A process in accordance with claim 1 in which the alloy particles are finer than 150 mesh.

13. A process in accordance with claim 1 in which said acryl binder is selected from polymers of acryl esters and methacryl esters, copolymers of acryl esters and methacryl esters, copolymers of said esters and monomers having functional groups copolymerizable with said esters.

14. A process in accordance with claim 1 in which said first and second layers are applied to the substrate by providing sheets of said alloy particles by mixing the particles with the acryl binders with addition of solvents to form mixtures, pouring the mixtures into molds and rolling the mixtures after drying, and then applying the sheets to the substrate.

15. A process in accordance with claim 14 in which said sheets are applied by using an acryl resin as an adhesive.

16. A process in accordance with claim 14 in which said sheets are applied by adhesive tapes.

17. A process in accordance with claim 1 in which said first layer is formed on the substrate and said second layer is formed on the first layer.

18. A process in accordance with claim 1 in which said non-oxidating atmosphere is provided one of inactive gas atmosphere, reducing gas atmosphere and vacuum.

19. A process in accordance with claim 1 in which a preheating is carried out at a temperature of 150° to 380° C. for 5 to 120 minutes prior to the heating step.

20. A process in accordance with claim 19 in which the preheating is carried out at a heating rate of 40° C./min.

* * * * *